US011666147B2

(12) United States Patent
Milligan et al.

(10) Patent No.: US 11,666,147 B2
(45) Date of Patent: Jun. 6, 2023

(54) DRAWER SLIDE LATCHING

(71) Applicants: Chuck Milligan, Santa Fe Springs, CA (US); Talia Minear, Santa Fe Springs, CA (US)

(72) Inventors: Chuck Milligan, Santa Fe Springs, CA (US); Talia Minear, Santa Fe Springs, CA (US)

(73) Assignee: ACCURIDE INTERNATIONAL INC., Santa Fe Springs, CA (US)

( * ) Notice: Subject to any disclaimer, the term of this patent is extended or adjusted under 35 U.S.C. 154(b) by 103 days.

(21) Appl. No.: 17/148,518

(22) Filed: Jan. 13, 2021

(65) Prior Publication Data

US 2021/0212462 A1 Jul. 15, 2021

Related U.S. Application Data

(60) Provisional application No. 62/960,491, filed on Jan. 13, 2020.

(51) Int. Cl.
*A47B 88/473* (2017.01)
*A47B 88/427* (2017.01)
*A47B 88/53* (2017.01)

(52) U.S. Cl.
CPC ..... *A47B 88/473* (2017.01); *A47B 88/427* (2017.01); *A47B 88/53* (2017.01)

(58) Field of Classification Search
CPC ..... A47B 88/473; A47B 88/427; A47B 88/53; A47B 2095/024; A47B 2210/0018; A47B 88/50; A47B 88/423
See application file for complete search history.

(56) References Cited

U.S. PATENT DOCUMENTS 4,749,242 A 6/1988 Rechberg
6,431,615 B1 * 8/2002 Bastian ..... E05C 3/165 292/121
6,527,353 B1 * 3/2003 Bradfish ..... A47B 88/944 312/333
6,547,289 B1 * 4/2003 Greenheck ..... E05B 65/46 292/200
6,817,685 B2 11/2004 Lammens
6,851,286 B2 * 2/2005 Dube ..... E05C 1/14 292/336.3
D535,551 S 1/2007 Milligan
(Continued)

FOREIGN PATENT DOCUMENTS

JP 2000-041769 A 2/2000
KR 10-2019-0035084 A 4/2019

OTHER PUBLICATIONS

International Search Reporton related PCT Application No. PCT/US2021/013323 from International Searching Authority (KIPO) dated May 11, 2021.

(Continued)

*Primary Examiner* — Hanh V Tran
(74) *Attorney, Agent, or Firm* — KOS IP Law LLP

(57) ABSTRACT

A release mechanism for a drawer slide latch may include linearly translatable elements. The linearly translatable elements may cause rotation of a lever arm used in latching one drawer slide member to another. The linearly translatable elements may be coupled to a drawer, or be a component mounted to the drawer slide, in various embodiments.

3 Claims, 18 Drawing Sheets

(56) References Cited

U.S. PATENT DOCUMENTS

| | | | | |
|---|---|---|---|---|
| 8,317,278 | B2 | 11/2012 | Enos | |
| 9,010,830 | B2 * | 4/2015 | Hanley | B60R 11/00 296/24.44 |
| 9,233,647 | B1 * | 1/2016 | Hanley | B60R 11/06 |
| 10,004,331 | B2 * | 6/2018 | Jeffries | E05B 65/46 |
| 10,172,452 | B2 * | 1/2019 | Hanley | B60P 3/007 |
| 10,231,540 | B1 * | 3/2019 | Hong | E05B 65/46 |
| 10,362,870 | B1 * | 7/2019 | Smith | A47B 88/407 |
| 10,455,937 | B2 | 10/2019 | Jeffries | |
| 10,641,010 | B2 * | 5/2020 | Sonney | A47B 88/944 |
| 2001/0017509 | A1 * | 8/2001 | Hallsten | E05B 65/46 312/333 |
| 2003/0132687 | A1 * | 7/2003 | Morris | E05B 65/46 312/333 |
| 2004/0080245 | A1 | 4/2004 | Lammens et al. | |
| 2007/0241651 | A1 | 10/2007 | Burgess, III et al. | |
| 2007/0257588 | A1 | 11/2007 | Chen et al. | |
| 2009/0102333 | A1 * | 4/2009 | Weng | A47B 95/02 292/300 |
| 2011/0169389 | A1 | 7/2011 | Jeffries et al. | |
| 2014/0339974 | A1 * | 11/2014 | Gill | B25H 3/028 312/333 |
| 2015/0061483 | A1 * | 3/2015 | Liu | E05C 3/14 312/332.1 |
| 2015/0327676 | A1 * | 11/2015 | Chang | A47B 88/57 312/319.1 |
| 2017/0150815 | A1 * | 6/2017 | Zhang | E05C 3/14 |
| 2018/0014638 | A1 * | 1/2018 | Hanley | A47B 88/50 |
| 2018/0279781 | A1 * | 10/2018 | Jeffries | E05B 65/46 |
| 2018/0320422 | A1 * | 11/2018 | Sharp | E05C 1/14 |
| 2019/0003219 | A1 * | 1/2019 | Doerflinger | E05B 65/46 |
| 2019/0231071 | A1 | 8/2019 | Smith | |

OTHER PUBLICATIONS

Written Opinion on related PCT Application No. PCT/US2021/013323 from International Searching Authority (KIPO) dated May 11, 2021.

* cited by examiner

DRAWER SLIDE LATCHING

CROSS REFERENCE TO RELATED APPLICATION

This application claims the benefit of the filing date of U.S. Provisional Patent Application No. 62/960,491, filed on Jan. 13, 2020, the disclosure of which is incorporated by reference herein.

BACKGROUND OF THE INVENTION

The present invention relates generally to cabinets, and more particularly to drawer cabinet latching systems.

Cabinets are often used to hold a variety of items in a convenient manner, with drawers of the cabinet extensible from the cabinet to allow for easy access to contents held by the drawers. At times, however, avoidance of inadvertent opening of the drawers may be desired.

BRIEF SUMMARY OF THE INVENTION

Some embodiments provide a drawer slide latch and release mechanism, comprising: a release lever pivotably mounted to a web of an inner member of a drawer slide, the release lever part of a structure including a tab for engagement in a catch of an outer member of the drawer slide, the tab of the structure including the release lever positioned within the catch with the release lever in a first position, and the tab of the structure including the release lever positioned free of the catch with the release lever in a second position, different than the first position; a mounting bracket with a forward edge; and a release bar including a top extending away from the forward edge of the mounting bracket, a portion of the top positioned above a forward end of the release lever, at least a portion of the top depressible such that depression of at least the portion of the top will position the release lever in the second position. In some embodiments the forward edge of the mounting bracket includes a slot, and the release bar includes a vertical wall partially extending into the slot, the vertical wall depressible further into the slot upon depression of at least the portion of the top. In some embodiments the release bar is pivotally mounted to a top of the forward edge of the mounting bracket.

Some embodiments provide a drawer slide latch and release mechanism, comprising: a release lever pivotably mounted to a web of an inner member of a drawer slide, the release lever part of a structure including a tab for engagement in a catch of an outer member of the drawer slide, the tab of the structure including the release lever positionable within the catch with the release lever in a first position, and the tab of the structure including the release lever positioned free of the catch with the release lever in a second position, different than the first position; a pivot arm extending over the release lever; an actuation arm fixedly coupled to the pivot arm; and a release bar having a pin for contacting the actuation arm, the release bar linearly displaceable, such that linear displacement of the release bar actuates the actuation arm to pivot the pivot arm to move the release lever from the first position to the second position.

Some embodiments provide a drawer slide with a latch mechanism, comprising: an outer member including a retaining hook formed in a forward edge of the outer member; an inner member extendably coupled to the outer member; and a release arm including a tab that may be captured by the retaining hook of the outer member with the inner member in a unextended position with respect to the outer member, the release arm extending from an end of a torsion spring mounted about a forward end of the inner member.

Some embodiments provide a drawer slide latch and release mechanism, comprising: a push blade displaceably mounted to a web of an inner member of a drawer slide, the push blade linearly displaceable to release a tab for engagement in a catch of an outer member of the drawer slide, the tab positionable within the catch with the push blade in a first position, and the tab positioned free of the catch with the push blade in a second position, different than the first position; and a member configured to be coupled to a front of a drawer, the member moveable so as to displace the push blade to the second position. In some embodiments the member is a lever arm pivotally coupled to a mount coupled to a front of the drawer or the inner member. In some embodiments the member is a push bar coupled to a front of the drawer.

These and other aspects of the invention are more fully comprehended upon review of this disclosure.

DETAILED DESCRIPTION

Figure 1:
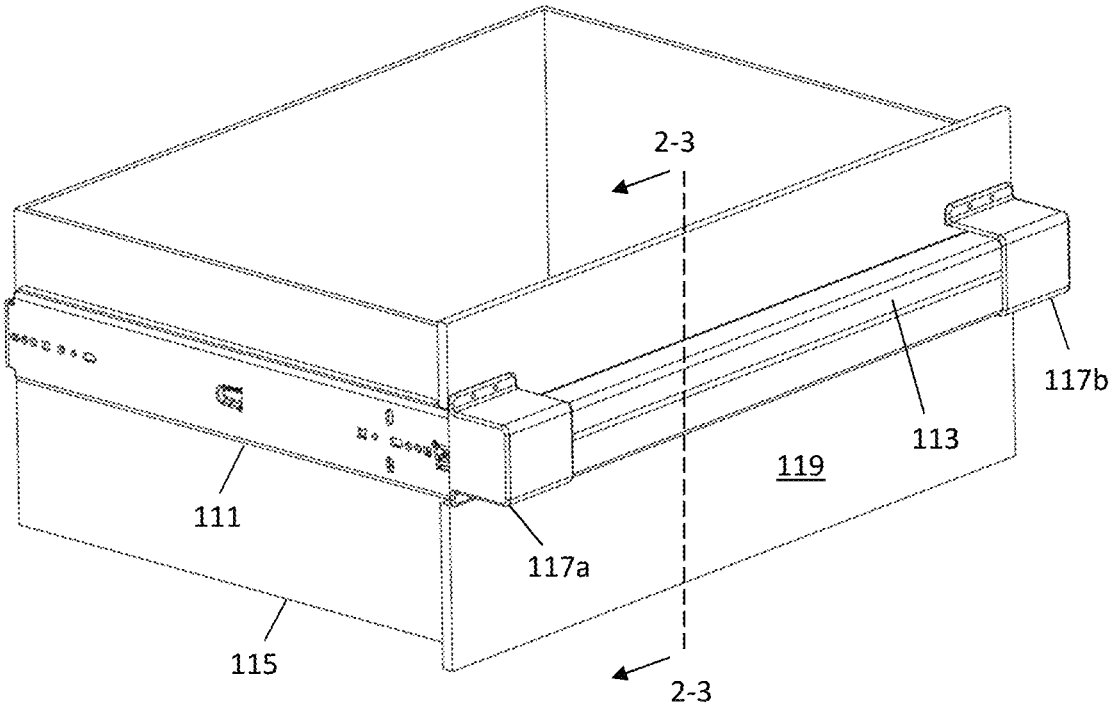
FIG. 1 is a perspective view showing a slide and release bar coupled to a drawer, in accordance with aspects of the invention.

FIG. 1 is a perspective view showing a slide 111 and release bar 113 coupled to a drawer 115. The slide is mounted to a side of the drawer, with usually a corresponding slide mounted to the drawer's opposing side (not visible in FIG. 1). The slide(s) allows for extension of the drawer from a cabinet or rack. The slide includes a latch for keeping the slides in the retracted position, hence keeping the drawer in a closed position. The release bar is coupled to a front 119 of the drawer by opposing end caps 117*a,b*, shown at opposing sides of the front of the drawer. Activation of the release bar unlatches the latch, allowing for extension of the slides, hence opening of the drawer. For the embodiment of FIG. 1, the release bar is activated by pressing down on the release bar.

Figure 2:
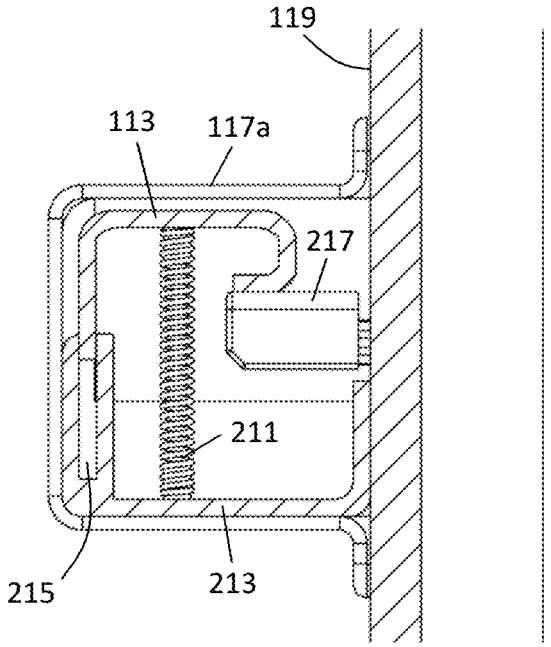
FIG. 2 is a cross-sectional view of the slide and release bar coupled to the drawer of FIG. 1, along the sectional line 2-3 shown in FIG. 1, in accordance with aspects of the invention.

FIG. 2 is a cross-sectional view of the slide and release bar coupled to the drawer of FIG. 1, along the sectional line 2-3 shown in FIG. 1. FIG. 2 shows the left end cap mounted to the face of the front of the drawer. The release bar is within an outline formed by the end cap. The release bar is shown in an unactivated position. In FIG. 2, a spring 211 is shown as normally biasing the release bar in an upwards direction.

A mounting bracket 213 is also coupled to the face of the front of the drawer, although the mounting bracket may be instead coupled to the end caps. The mounting bracket includes a vertical forward slot 215, away from the drawer, with a forward vertical wall of the release bar partially extending into the slot. A top of the release bar extends toward the face of the front of the drawer. A curled end from the top of the release bar, the end towards the drawer, is positioned above a forward end of a release lever 217 for the drawer slide. In various embodiments the end is not curled, with either a bottom side of the top of the release bar or some extension from the top of the release positioned above the release lever. The release lever serves to unlatch an inner slide member of the drawer slide from an outer slide member of the drawer slide.

Figure 3:
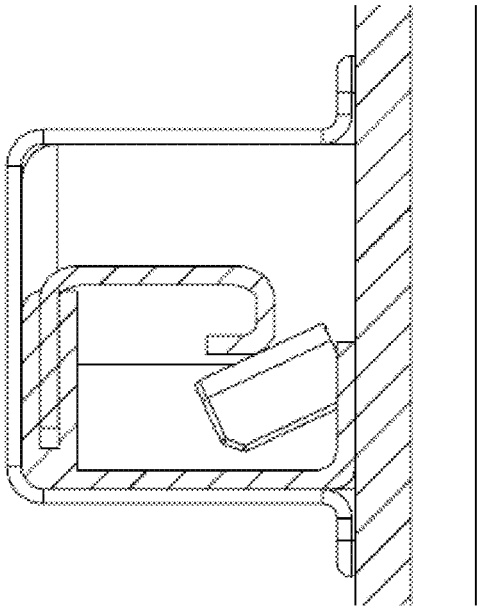
FIG. 3 is also a cross-sectional view of the slide and release bar coupled to the drawer of FIG. 1, along the sectional line 2-3 shown in FIG. 1, in accordance with aspects of the invention.

FIG. 3 is also a cross-sectional view of the slide and release bar coupled to the drawer of FIG. 1, along the sectional line 2-3 shown in FIG. 1, but with the release bar in the activated position (and the spring not shown for clarity). In FIG. 3, the top of the release bar has been pressed downward. With the release bar pressed downward, the forward vertical wall of the release bar more fully extends into the slot of the mounting bracket, and the curled end of the release bar presses the forward end of the release lever downward.

Figure 4:
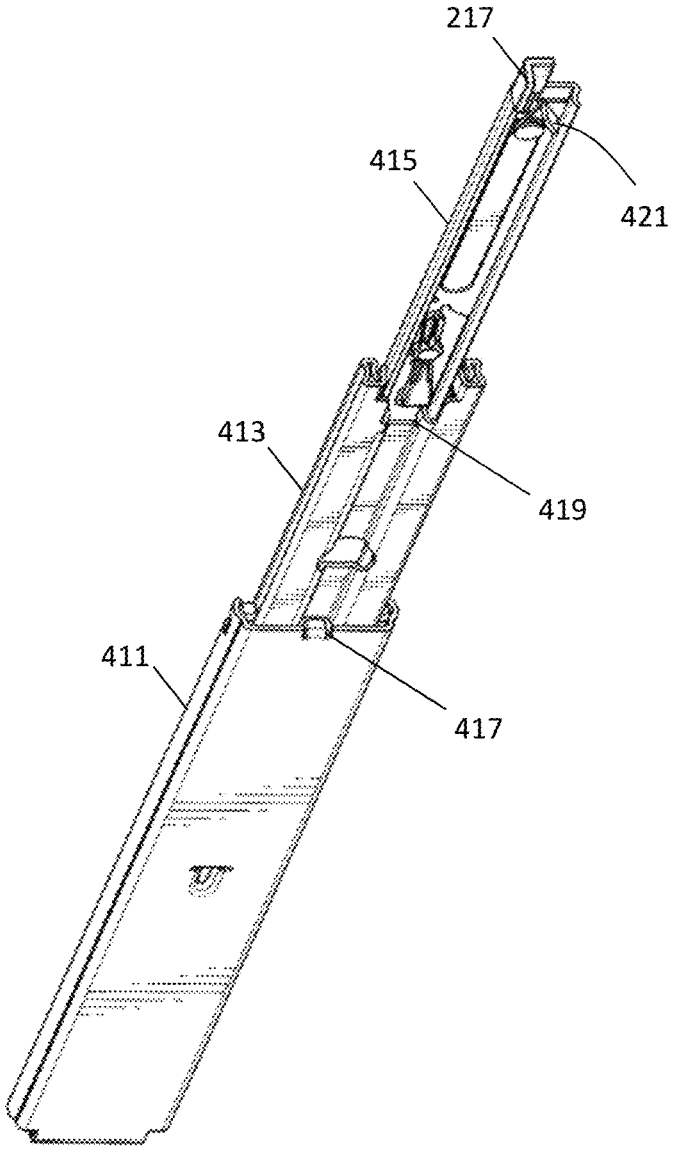
FIG. 4 is a perspective view of a drawer slide that may be used with the invention.

FIG. 4 is a perspective view of a drawer slide that may be used with the invention. The drawer slide includes a latch arm on an extending member of the drawer slide, and a latch receiver on a fixed member of the drawer slide. For FIG. 4, the drawer slide is a three member telescopic drawer slide. In various embodiments, the number of slide members may vary, and the drawer slide may be of a different type than a telescopic drawer slide.

The drawer slide of FIG. 4 includes an outer member 411, an intermediate member 413, and an inner slide member 415. Each member, whether the outer member, intermediate member, or inner member, generally comprises a longitudinal vertical web with raceways extending horizontally from upper and lower margins of the vertical web. The raceways of the outer member and the intermediate member and the raceways of the intermediate member and inner member may be in contact with one another, as in a friction drawer slide. Perhaps more commonly, and as with the drawer slide of FIG. 4, sets of bearings slidably or rollably couple the raceways of the outer member and the intermediate member, and sets of bearings slidably or rollably couple the raceways of the intermediate member and inner member.

The outer member 411 is normally mounted to a cabinet frame or sidewall. The intermediate member 413 is nested within the outer member, with the intermediate member extendably coupled to the outer member. The inner member 415, in turn is nested within the intermediate member, with the inner member extendably coupled to the intermediate member. The inner member is normally mounted to a side of a drawer within the cabinet.

A release lever 217 extends forward from the front of the inner member. The release lever is mounted to a pin or shoulder rivet, attached to the web of the inner member. A torsion spring, also attached to the pin or shoulder rivet, normally biases the release lever to an upward position, flush with and continuing a longitudinal line formed by the length of the upper raceway of the inner member. A tab 421 extends from a portion of a structure of the release tab. The tab extends in an inward direction from the web of the inner member, towards the outer member, with the slide in a retracted or closed position. The tab includes a ramped surface, so as to partially rotate the release lever, to allow the tab to pass under a catch 417 of the outer member. The catch 417 may be a bent over portion at the end of the forward end of the outer member, positioned so as to capture the tab. Alternatively, the catch may in the form of a hook, shaped out of the web of the outer member, for example as shown in FIG. 1 (and later in FIGS. 13-14 and elsewhere). The intermediate member includes a cutout 419, positioned so as to allow the tab to interact with the catch of the outer member.

Figure 5:
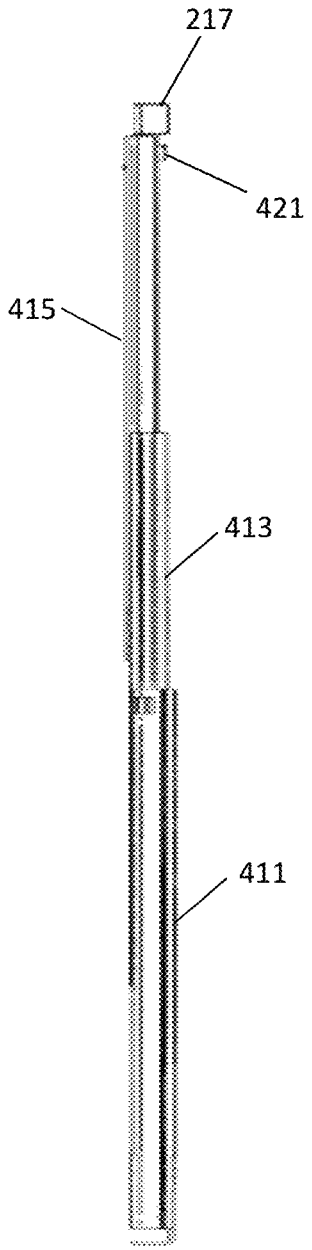
FIG. 5 shows a top view of the slide of FIG. 4, in the extended position.

FIG. 5 shows a top view of the slide of FIG. 4, in the extended position. The top view shows the outer member 411, the intermediate member 413 extending from the outer member, and the inner member 415 extending from the intermediate member. The top view also shows the release lever 217 extending forward from the inner member, and the tab 421 extending outward from the inner member in a direction towards a plane defined by the web of the outer member. FIG. 5 shows that the tab extends sufficiently far so as to engage with the catch of the outer member.

Figure 6:
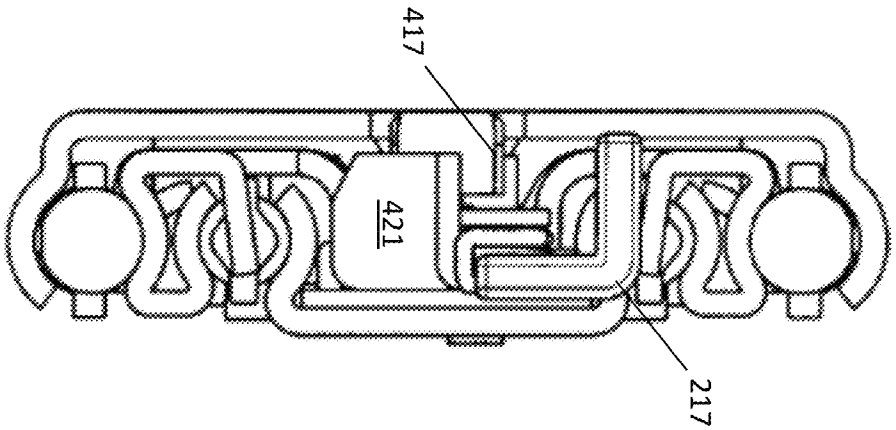
FIG. 6 shows a front view of the slide of FIG. 4, also in the extended position.

FIG. 6 shows a front view of the slide of FIG. 4, also in the extended position. The front view illustrates the ramped tab 421 as positioned below the release lever 217, with the ramped tab extending sufficiently far so as to allow for capture of the tab by the catch 417.

Figure 7:
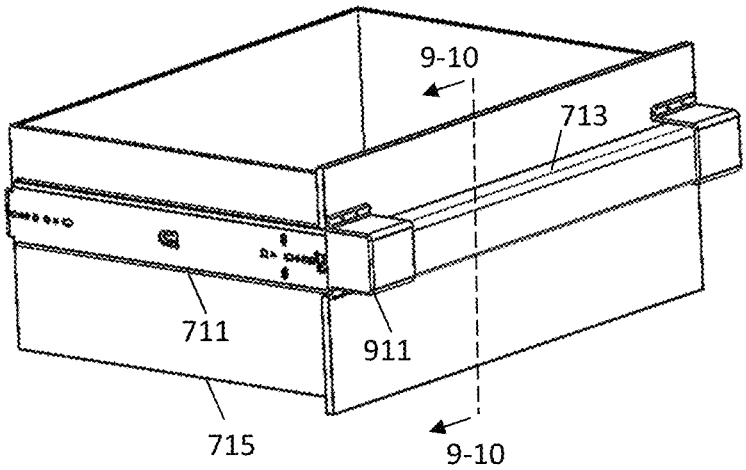
FIG. 7 is a perspective view showing a slide and an alternative release bar coupled to a drawer, in accordance with aspects of the invention.

FIG. 7 is a perspective view showing a slide 711 and an alternative release bar 713 coupled to a drawer 715. As with the embodiment of FIG. 1, the slide is mounted to a side of the drawer, with usually a corresponding slide mounted to the drawer's opposing side (not visible in FIG. 7). The slide(s) allows for extension of the drawer from a cabinet or rack. The slide includes a latch for keeping the slides in the retracted position, hence keeping the drawer in a closed position. The release bar is coupled to a front of the drawer by opposing end caps, shown at opposing sides of the front of the drawer. Activation of the release bar unlatches the latch, allowing for extension of the slides, hence opening of the drawer. For the embodiment of FIG. 7, the release bar is activated by pressing down on the release bar.

Figure 8:
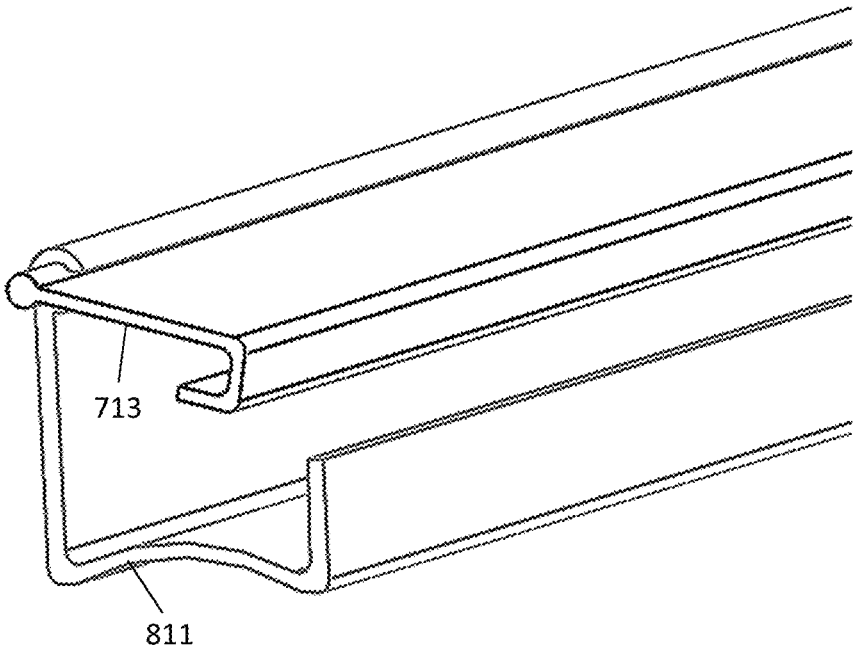
FIG. 8 shows a perspective view of a portion of the alternative release bar, pivotally engaged with a mounting bracket, in accordance with aspects of the invention.

FIG. 8 shows a perspective view of a portion of the alternative release bar, pivotally engaged with a mounting bracket 811. The mounting bracket forms a generally U-shaped channel, with a top forward edge having a slot to receive a forward edge of the top of the release bar. The slot is somewhat rounded, as is the forward edge of the top of the release bar, such that forward edge of the top of the release bar is captured within the slot.

Figure 9:
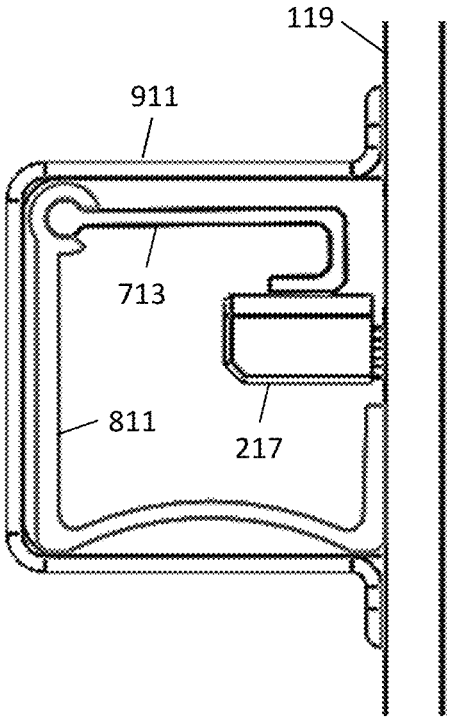
FIG. 9 is a cross-sectional view of the slide and alternative release bar coupled to the drawer of FIG. 7, along the sectional line 9-10 shown in FIG. 7.

FIG. 9 is a cross-sectional view of the slide and alternative release bar coupled to the drawer of FIG. 7, along the sectional line 9-10 shown in FIG. 7. Similar to FIG. 2, FIG. 9 shows the left end 911 cap mounted to the face of the front of the drawer. The release bar is within an outline formed by the end cap. The release bar is shown in an unactivated position. A spring may be used to normally bias the release bar in an upwards direction, as discussed with respect to FIG. 2, but the spring is omitted from FIG. 9 for clarity.

The mounting bracket is also coupled to the face of the front of the drawer, although the mounting bracket may be instead coupled to the end caps. The top of the release bar extends from the slot of the mounting bracket and towards the face of the front of the drawer. A curled end from the top of the release bar, the end towards the drawer, is positioned above a forward end of a release lever for the drawer slide. In various embodiments the end is not curled, with either a bottom side of the top of the release bar or some extension from the top of the release positioned above the release lever. The release lever serves to unlatch an inner slide member of the drawer slide from an outer slide member of the drawer slide.

Figure 10:
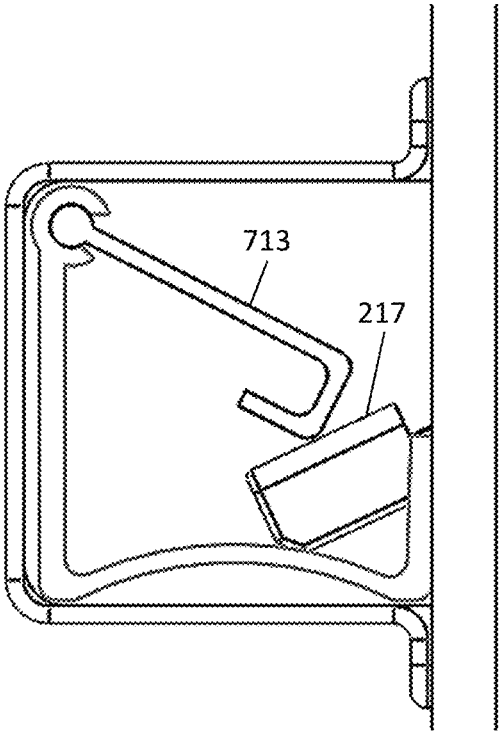
FIG. 10 is also a cross-sectional view of the slide and alternative release bar coupled to the drawer of FIG. 7, along the sectional line 9-10 shown in FIG. 7.

FIG. 10 is also a cross-sectional view of the slide and alternative release bar coupled to the drawer of FIG. 7, along the sectional line 9-10 shown in FIG. 7, but with the release bar in the activated position. In FIG. 10, the top of the release bar has been pivoted downward. With the release bar pivoted downward, the curled end of the release bar presses the forward end of the release lever 217 downward.

FIGS. 9 and 10 also show the bottom of the U-shaped channel of the mounting bracket as having a longitudinal convex surface. The convex surface may be convenient in that the convex surface may act as a stop for downward movement of the release lever, thereby also limiting extent of pivoting of the top of the release bar.

Figure 11:
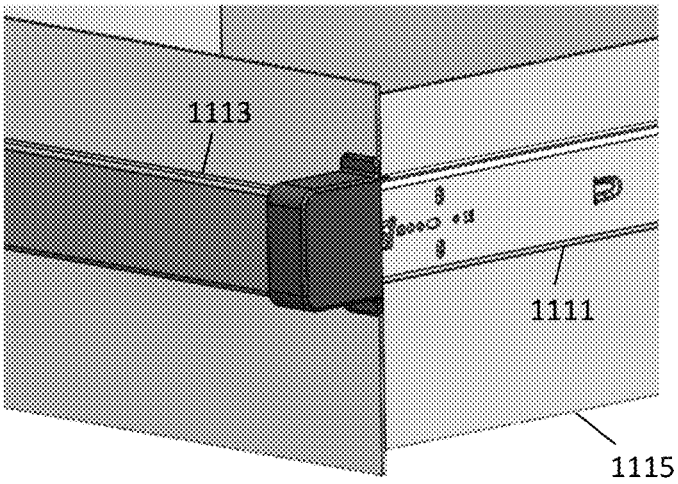
FIG. 11 is a perspective partial view showing a slide and a further release bar coupled to a drawer, in accordance with aspects of the invention.

FIG. 11 is a perspective partial view showing a slide 1111 and a further release bar 1113 coupled to a drawer 1115. As with FIGS. 1 and 7, the slide is mounted to a side of the drawer, with usually a corresponding slide mounted to the drawer's opposing side (not visible in FIG. 1). The slide(s) allows for extension of the drawer from a cabinet or rack. The slide includes a latch for keeping the slides in the retracted position, hence keeping the drawer in a closed position. The release bar is coupled to a front of the drawer by opposing end caps, at opposing sides of the front of the drawer, with only a right end cap shown in the partial view of FIG. 11. Activation of the release bar unlatches the latch, allowing for extension of the slides, hence opening of the drawer. For the embodiment of FIG. 11, the release bar is activated by squeezing the release bar and the mounting bracket to which the release bar is coupled.

Figure 12:
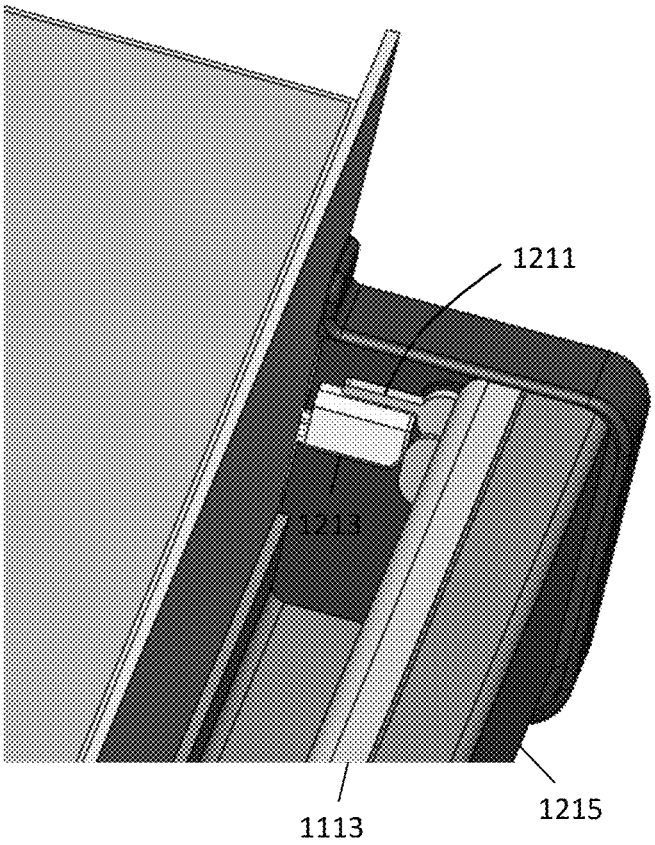
FIG. 12 is a perspective partial view of the slide and further release bar coupled to the drawer of FIG. 11.

FIG. 12 is a perspective partial view of the slide and further release bar coupled to the drawer of FIG. 11. FIG. 12 shows a portion of a pivot arm 1211, with the pivot arm extending over a release lever 1213 of the slide. The pivot arm is pivoted through displacement of the release bar away from the drawer, which may be accomplished by squeezing the release bar and the mounting bracket 1215.

Figure 13:
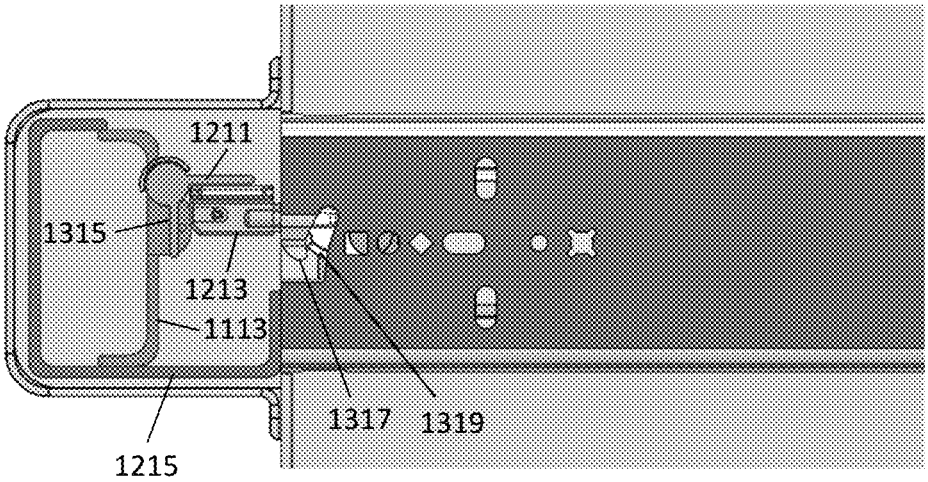
FIG. 13 is a side view of the slide and further release bar coupled to the drawer of FIG. 11.

FIG. 13 is a side view of the slide and further release bar coupled to the drawer of FIG. 11, with the side of the end cap made transparent. The mounting bracket has a horizontal lower surface extending away from the face of the front of the drawer, a vertical wall extending upward from a forward edge of the lower surface, and a horizontal upper surface extending back to the drawer from an upper edge of the vertical wall. The surfaces of the mounting bracket form a somewhat C-shaped channel facing the drawer, and the release bar is dimensioned so as to fit in the C-shaped channel of the mounting bracket.

The embodiment of the release bar of FIG. 13 is also shown as having a generally C-shaped cross-section, facing outward away from the drawer. In many embodiments a spring, not shown, normally biases the release bar away from the vertical wall of the mounting bracket. A tab 1311 extends from a vertical portion of the channel, with the tab extending towards the drawer. The tab includes a pin 1313 for contacting an actuation arm 1315, with the actuation arm coupled to a base of the pivot arm with extends over the release lever. The release lever also includes a tab 1319, extending out of the page in FIG. 13, with the tab captured in a catch slot of a receiver of an outer member of the drawer slide. The receiver of the outer member is slightly different than that of the drawer slide of FIGS. 4-6. For the outer member of FIG. 13, the receiver may be considered to provide an opening extending into a front edge of the outer member, with the opening further including the catch slot extending vertically upwards. The receiver therefore may be considered to create a retaining hook 1317 in the outer slide member, with the tab of the release lever to be captured by the retaining hook.

Figure 14:
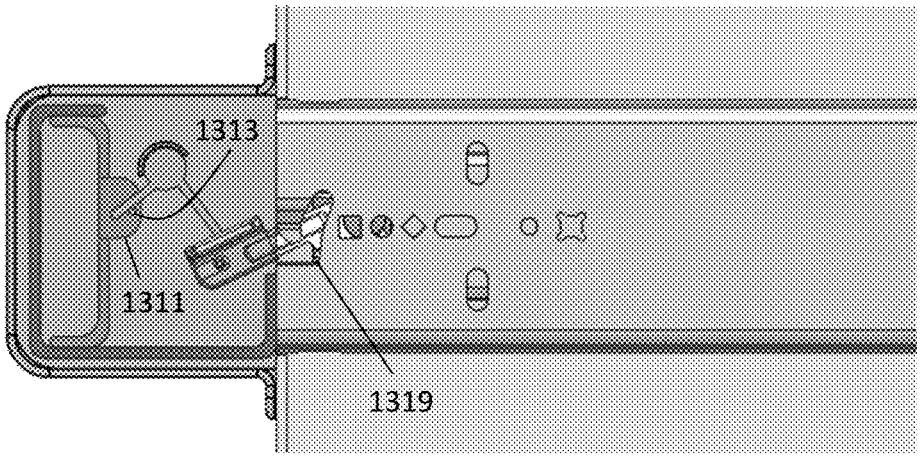
FIG. 14 is also a side view of the slide and further release bar coupled to the drawer of FIG. 11.

FIG. 14 is also a side view of the slide and further release bar coupled to the drawer of FIG. 11, with the side of the end cap made transparent. In FIG. 14, however, the release bar has been actuated, resulting in the tab of the release lever exiting the catch slot and clearing the hook of the outer member. In FIG. 14 the release bar has been displaced towards the vertical wall of the mounting bracket. With such forward displacement of the release bar, the pin pushes the actuation arm, resulting in pivoting of the pivot arm downward. The pivoting of the pivot arm downward in turn pushes the release lever downward, such that the tab of the release lever clears the retaining hook of the outer member of the drawer slide. As the release lever is mounted to the inner member, the inner member is now free to extend from the outer member.

Figure 15:
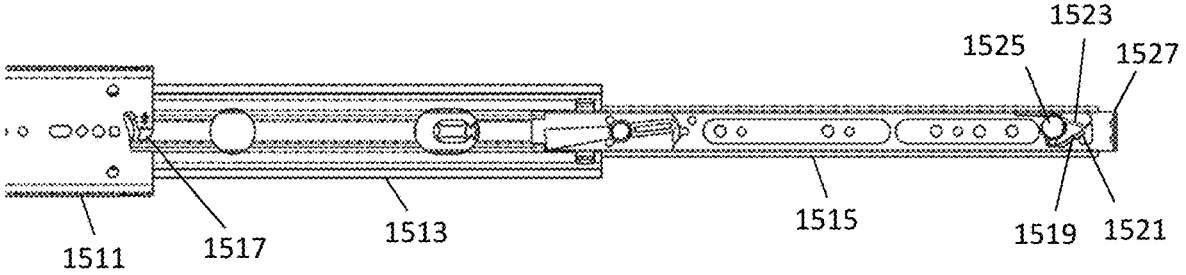
FIG. 15 shows portions of a further drawer slide, in an extended position, in accordance with aspects of the invention.

FIG. 15 shows portions of a further drawer slide, in an extended position. The further drawer slide may be used to extendably couple a drawer to in a cabinet or rack. As with the drawer slide of FIG. 4, the slide of FIG. 15 includes an outer member 1511, an intermediate member 1513, and an inner member 1515. The intermediate member is extendably coupled to the outer member, and the inner member is extendably coupled to the intermediate member. The outer member includes a retaining hook 1517 formed of a cutout in a forward edge of the outer member.

In FIG. 15, a release arm 1519 is mounted about a forward edge of the inner member, with the release arm including a tab 1521 that may be captured by the retaining hook of the outer member. The intermediate member includes a cutout in its forward edge, allowing for capture of the tab of the release arm by the retaining hook of the outer member, with the drawer slide in the retracted or unextended position.

The release arm extends from an end of an arm of a torsion spring 1523, with the release arm extending rearward and at a slightly downward angle along the length of the inner member. The torsion spring is mounted on a pin 1525 or shoulder rivet extending out from a web of the inner member, with the arm of the torsion spring extending forward and at a slightly downward angle along the length of the inner member. In various embodiments the release arm may instead so extend from an end of another arm, for example also mounted to the pin or shoulder rivet, with the torsion spring configured to act on the other arm.

A push blade 1527 extends out from the web of the forward end of the inner member. The push blade, when displaced inward towards a rear of the inner member, displaces the release arm downward and slightly rearward. The push blade may do so by way of an edge, ramp, or pin, contacting the arm of the torsion spring, the other arm, or apex between such and the release arm, or the tab of the release arm, depending on the embodiment.

Figure 16:
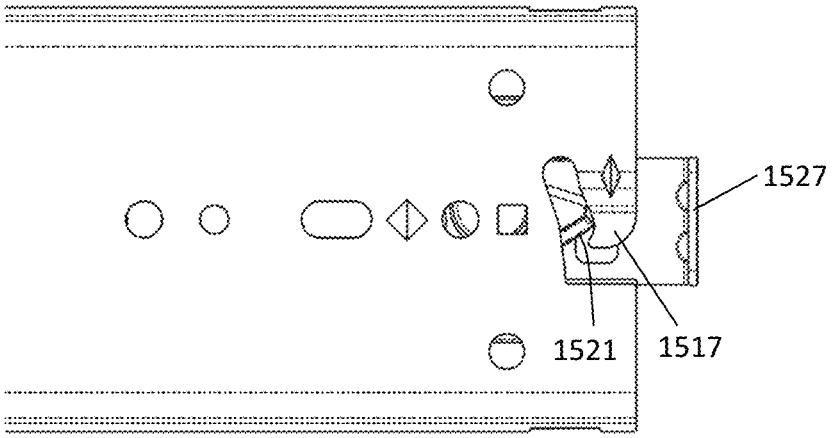
FIGS. 16 and 17 are a side view of the further drawer slide of FIG. 15.
Figure 17:
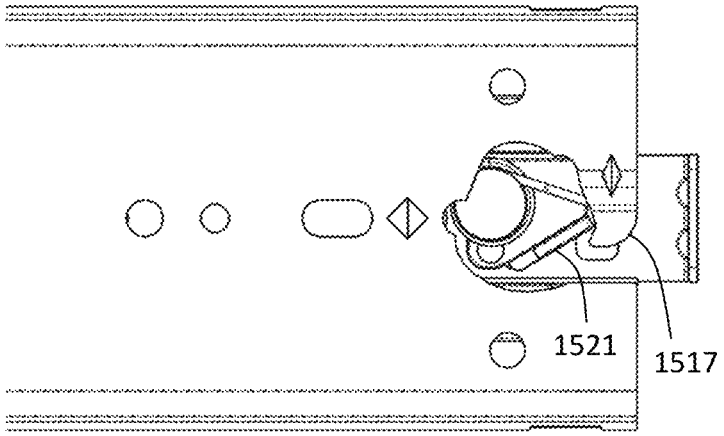

FIGS. 16 and 17 are a side view of the further drawer slide of FIG. 15, in the retracted position. In FIG. 16, the tab of the release arm is captured in the hook of the outer member. With the tab so captured, the inner member is prevented from extending forward. FIG. 17 shows the same view as FIG. 16, with a portion of the outer member cut away, so as to more fully show the release arm and associated components.

Figure 18:
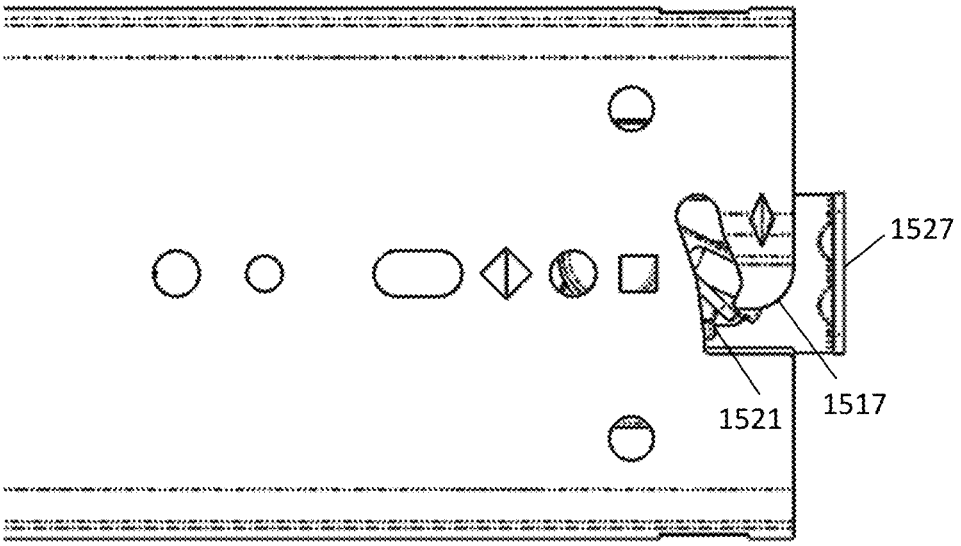
FIGS. 18 and 19 are also a side view of the further drawer slide of FIG. 15.
Figure 19:
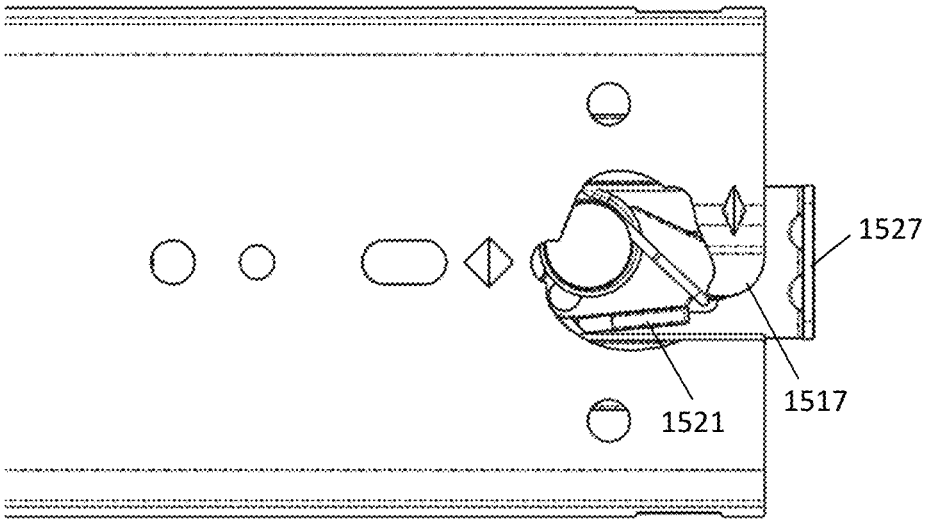

FIGS. 18 and 19 are also a side view of the further drawer slide of FIG. 15, in the retracted position. In the views of FIGS. 18 and 19, however, the push blade has been displaced inward, and the tab of the release arm is clear of the hook of the outer member. With the tab clear of the hook of the outer member, the inner member is free to extend forward.

Figure 20:
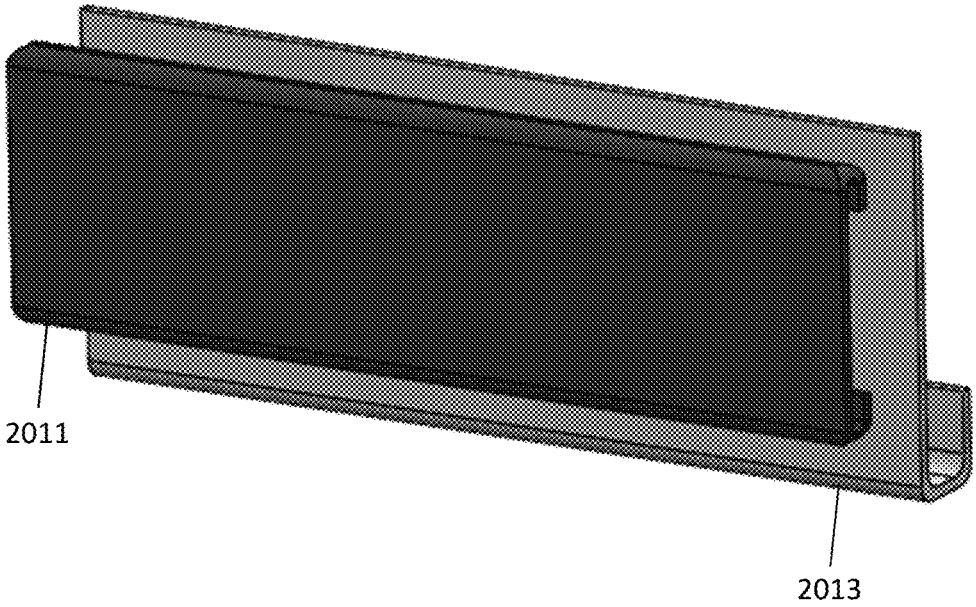
FIG. 20 is a perspective view of a push bar and mounting bracket that may be used with the further drawer slide of FIG. 15, in accordance with aspects of the invention.

FIG. 20 is a perspective view of a push bar 2011 and mounting bracket 2013 that may be used with the further drawer slide of FIG. 15. The push bar has a substantially planar face, offset in parallel from a substantially planar face of the mounting bracket. For convenience, the push bar has upper and lower edges curled towards the mounting bracket and the mounting bracket has a generally U-shaped square channel extending rearward along the bottom of the planar face, for use in attaching the mounting bracket to a drawer front.

Figure 21:
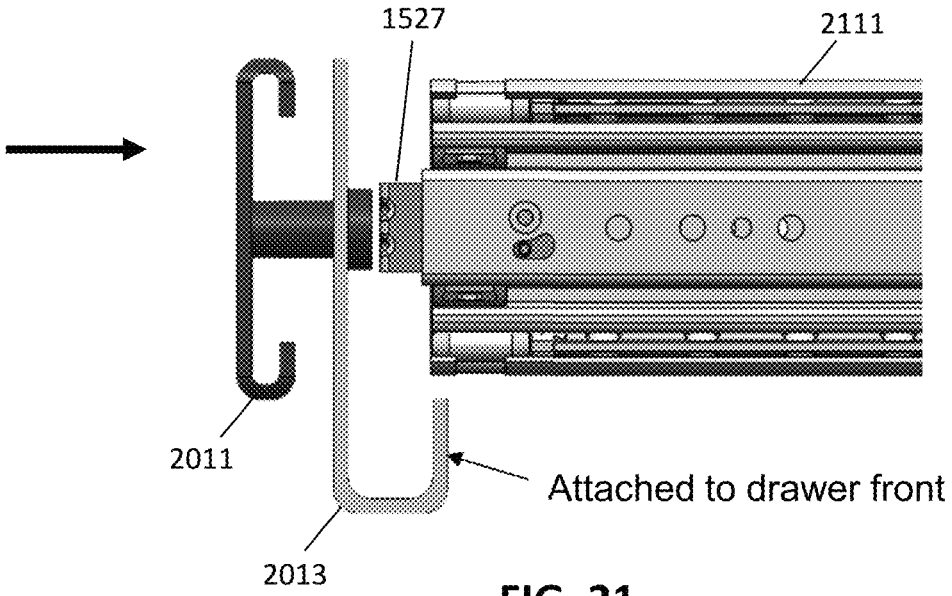
FIGS. 21 and 22 are side views of the push bar and mounting bracket of FIG. 20 coupled to a drawer slide, in accordance with aspects of the invention.
Figure 22:
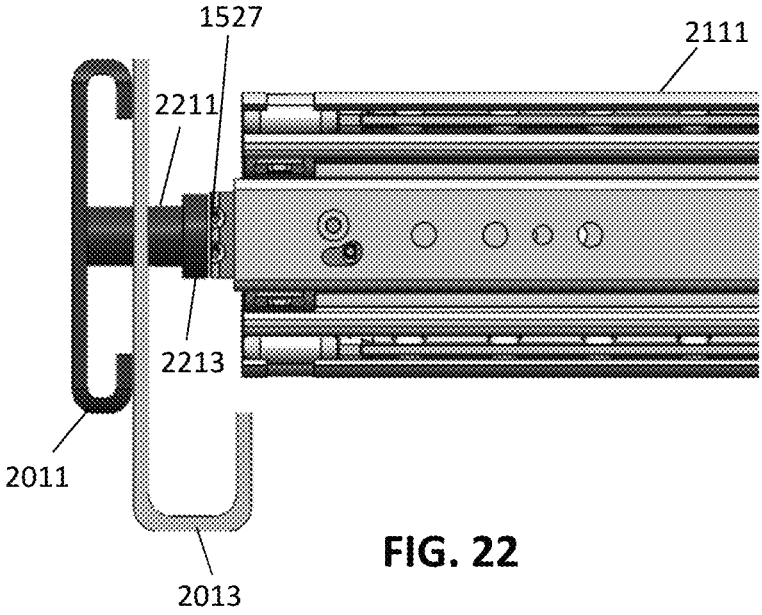

FIGS. 21 and 22 are side views of the push bar and mounting bracket of FIG. 20 coupled to a drawer slide 2111, for example the drawer slide of FIG. 15. The push bar having a neck 2211 extending through the mounting bracket, for example through an aperture in the mounting bracket. The neck ends in a head 2213, aligned with and proximate a front edge of the push blade 1529 of the drawer slide. FIG. 21 shows the push bar positioned away from the mounting bracket, and in various embodiments a spring or other mechanism may be used to normally bias the push bar away from the mounting bracket. FIG. 22 shows the push bar pressed against the face of the mounting bracket, pressing the head into the blade of the drawer slide, thereby causing the blade to move inward and release the tab of the release arm from the hook of the outer member.

Figure 23:
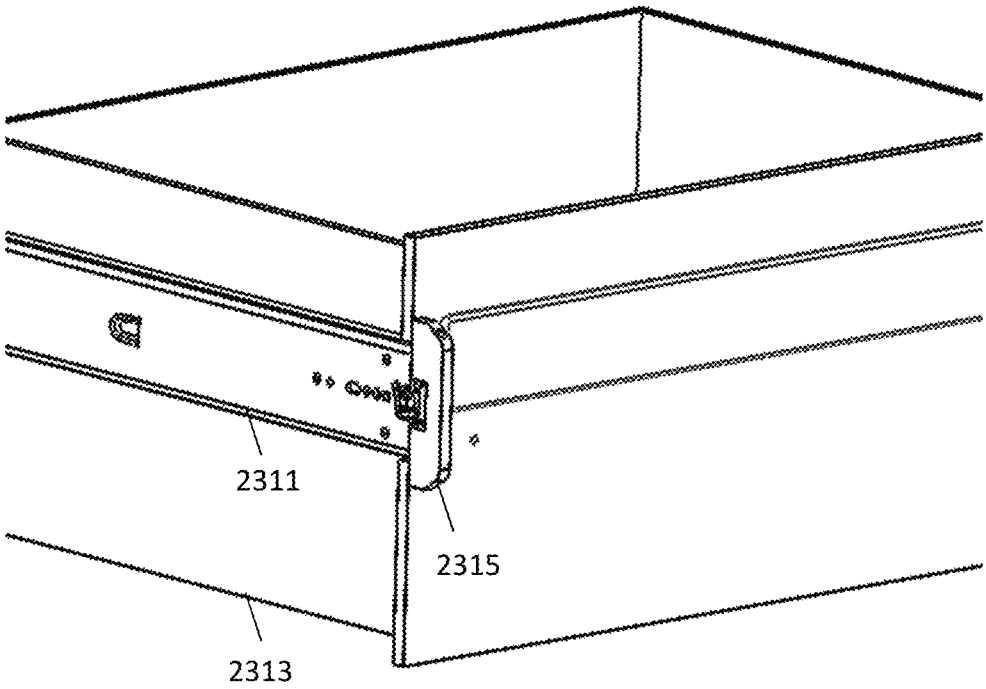
FIG. 23 is a perspective partial view showing a slide coupled to a drawer, with a mount for a lever coupled to a face of the drawer, in accordance with aspects of the invention.

FIG. 23 is a perspective partial view showing a slide 2311 coupled to a drawer 2313, with a mount 2315 for a lever coupled to a face of the drawer, or alternatively to the slide. As with FIG. 1, the slide is mounted to a side of the drawer, with usually a corresponding slide mounted to the drawer's opposing side (not visible in FIG. 23). The slide(s) allows for extension of the drawer from a cabinet or rack. The slide includes a latch for keeping the slides in the retracted position, hence keeping the drawer in a closed position. The slide may be as discussed with respect to FIG. 15.

Figure 24:
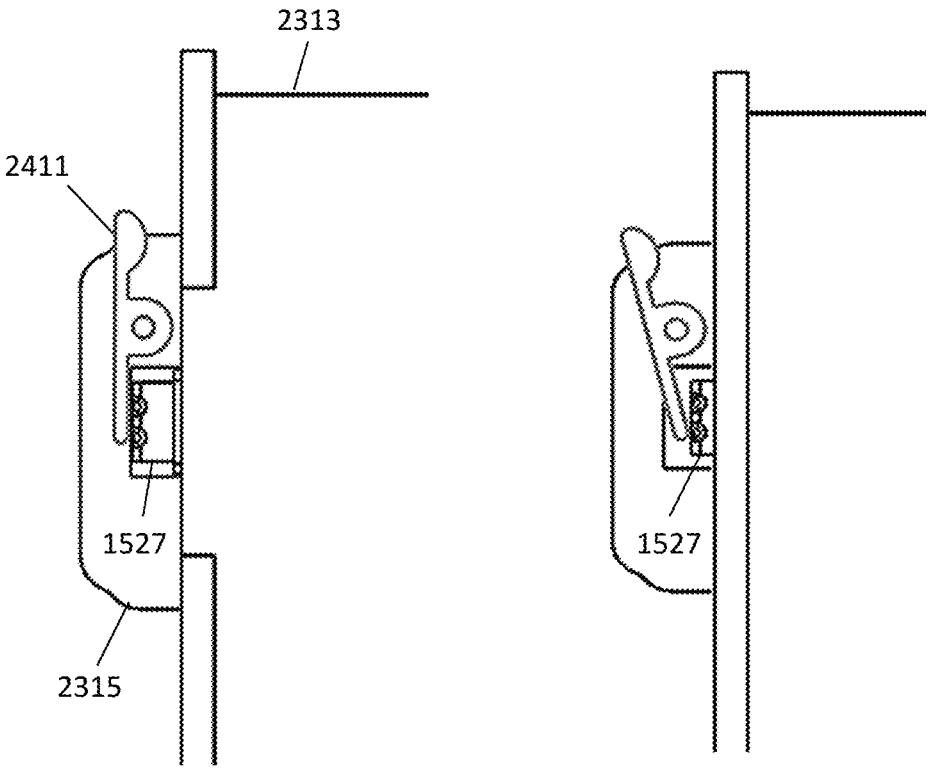
FIG. 24 shows a side view of the drawer, one of the mounts, and a lever coupled to the mount, in accordance with aspects of the invention.

FIG. 24 shows a side view of the drawer, one of the mounts, and a lever 2411 coupled to the mount.

Figure 25:
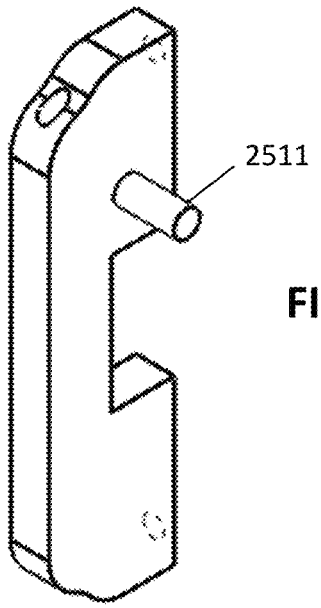
FIG. 25 shows an example of a mount, in accordance with aspects of the invention.

Also visible is a forward end of the blade 1527 for releasing the latch, by way of releasing the tab of the release arm of the inner member from the hook of the outer member of the drawer slide. The lever may be mounted to a pin 2511 extending from a side of the mount, as may be seen in FIG. 25. As shown in FIG. 24 the lever includes a socket or aperture for receiving the pin, approximately halfway along the length of the lever in FIG. 24, although various embodiments may otherwise position the socket or aperture. Rotation of a first part of the lever away from the drawer causes the lever to pivot about the pin, with a second part of the lever moving towards the drawer, as may be seen in FIG. 24. An end of the lever moving towards the drawer is aligned with the blade of the inner member, pushing the blade inward so as to release the release tab from the hook of the outer member, for example as discussed with respect to FIGS. 15, 18 and 19.

Figure 26:
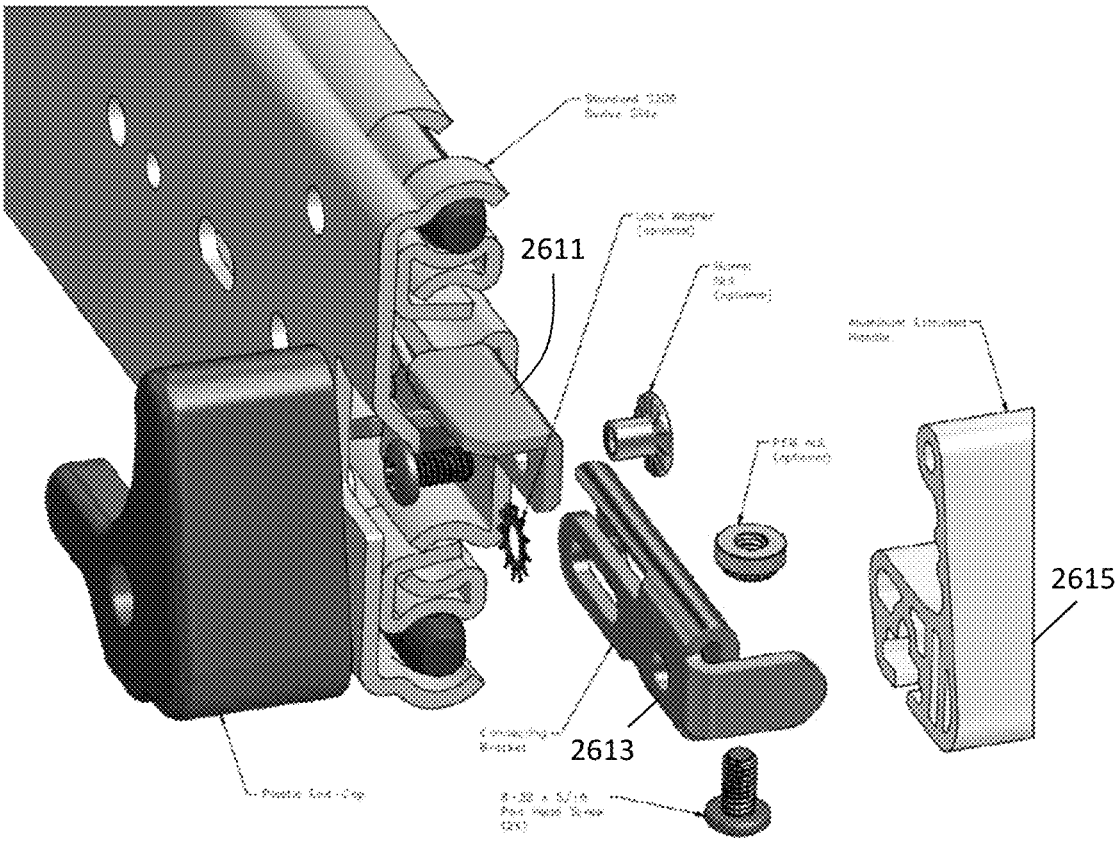
FIG. 26 shows a further embodiment of a mechanism for releasing a latch of a drawer slide, in accordance with aspects of the invention.

FIG. 26 shows a further embodiment of a mechanism for releasing a latch of a drawer slide. In FIG. 26, a connecting bracket 2613 may be coupled to a lever arm 2611, for example of the slide of FIG. 4. The connecting bracket may be used to operate the lever so as to release the latch. Alternatively, a handle 2615 may be mounted to the connecting bracket, to possibly increase ease of operation.

Figure 27:
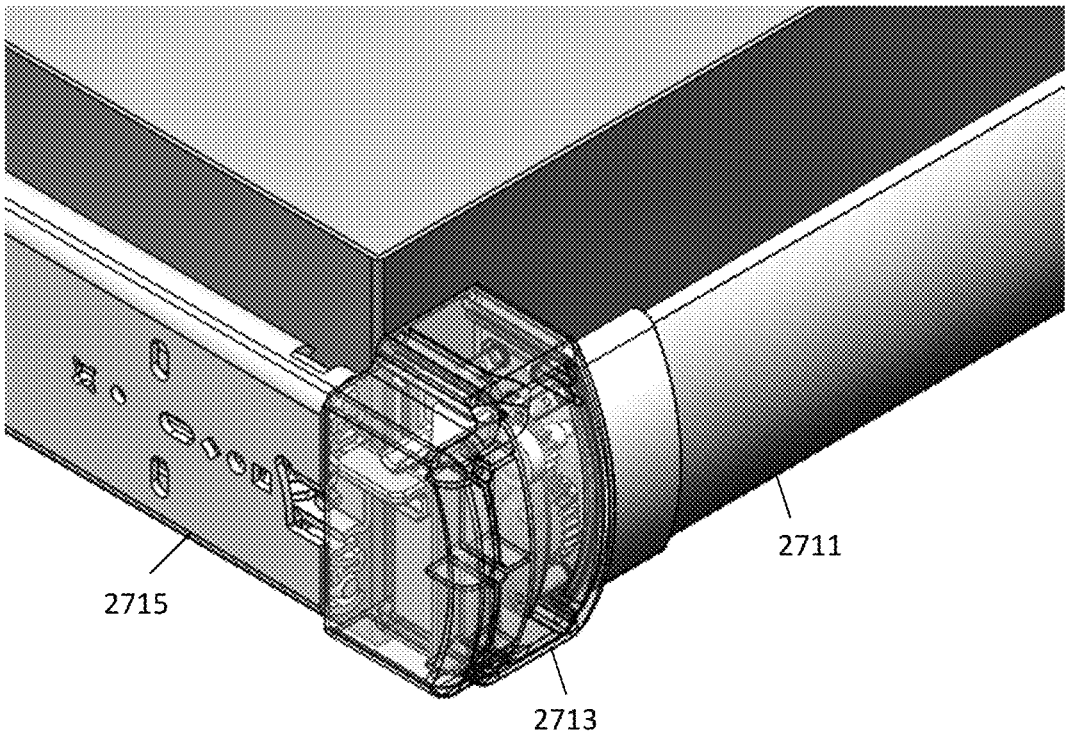
FIG. 27 shows a further embodiment of a release bar coupled to a slide, in accordance with aspects of the invention.

FIG. 27 shows a further embodiment of a release bar 2711 coupled to a slide 2715, in turn mounted to a side of a drawer. The release bar may be moved both upward and downward to release a latch of the slide. For FIG. 27, gearing is provided in an end cap 2713 to which the release bar is mounted, with the gearing allowing for bidirectional operation of the release bar.

Although the invention has been discussed with respect to various embodiments, it should be recognized that the invention comprises the novel and non-obvious claims supported by this disclosure.

What is claimed is:

1. A drawer slide latch and release mechanism, comprising:

a release lever pivotably mounted to a web of an inner member of a drawer slide, the release lever being part of a structure including a tab for engagement in a catch of an outer member of the drawer slide, the tab of the structure including the release lever positioned within the catch with the release lever in a first position, and the tab of the structure including the release lever positioned free of the catch with the release lever in a second position, different than the first position;

a mounting bracket with a forward edge; and a release bar including a top extending away from the forward edge of the mounting bracket, at least a portion of the top positioned above a forward end of the release lever, at least the portion of the top depressible such that depression of at least the portion of the top will position the release lever in the second position;

wherein the forward edge of the mounting bracket includes a slot, and the release bar includes a vertical wall partially extending into the slot, the vertical wall depressible further into the slot upon depression of at least the portion of the top.

2. The drawer slide latch and release mechanism of claim 1, further comprising a spring biasing the top to a position such that the release lever is in the first position.

3. The drawer slide latch and release mechanism of claim 1, wherein the top portion of the top positioned above the forward end of the release lever includes a curled end.

* * * * *